US009238961B2

(12) United States Patent
Bedouet

(10) Patent No.: US 9,238,961 B2
(45) Date of Patent: Jan. 19, 2016

(54) OILFIELD OPERATION USING A DRILL STRING

(75) Inventor: Sylvain Bedouet, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 893 days.

(21) Appl. No.: 13/500,117

(22) PCT Filed: Oct. 4, 2010

(86) PCT No.: PCT/US2010/051292

§ 371 (c)(1),
(2), (4) Date: Aug. 27, 2012

(87) PCT Pub. No.: WO2011/044028

PCT Pub. Date: Apr. 14, 2011

(65) Prior Publication Data

US 2012/0305315 A1 Dec. 6, 2012

Related U.S. Application Data

(60) Provisional application No. 61/248,715, filed on Oct. 5, 2009.

(51) Int. Cl.
*E21B 47/07* (2012.01)
*E21B 17/02* (2006.01)
(Continued)

(52) U.S. Cl.
CPC ..... *E21B 47/065* (2013.01); *E21B 17/025* (2013.01); *E21B 33/076* (2013.01); *E21B 49/001* (2013.01)

(58) Field of Classification Search
CPC ... E21B 17/025; E21B 49/001; E21B 47/065; E21B 17/06; E21B 17/07; E21B 17/076
See application file for complete search history.

(56) References Cited

U.S. PATENT DOCUMENTS 3,643,505 A 2/1972 Kisling, III
3,653,439 A 4/1972 Kisling, III
(Continued)

FOREIGN PATENT DOCUMENTS

EP 0120151 A1 10/1984
WO 2008100156 A1 8/2008
WO 2009-085812 A2 7/2009

OTHER PUBLICATIONS

International Preliminary Report on Patentability of PCT Application Serial No. PCT/US2010/051292 dated May 13, 2011.
(Continued)

*Primary Examiner* — Robert E Fuller
(74) *Attorney, Agent, or Firm* — Kenneth L. Kincaid

(57) ABSTRACT

Collecting temperature data at a plurality of locations along a wellbore, performing thermo-mechanical simulations of a drill string in response to mud circulation wherein the drill string comprises a tool string suspended in the wellbore from a pipe string, determining changes in length of the pipe string due to temperature changes, positionally fixing the tool string at one of the locations, and adjusting the length of the pipe string based on the determined change in length of the pipe string. Positionally fixing the tool string may comprise lowering the drill string a side entry sub of the drill string is proximate a top end of the wellbore wherein the side entry sub is configured to allow a wireline cable to enter a bore of the drill string, positioning the side entry sub above a blow-out-preventer, and closing the blow-out-preventer around the drill string below the side entry sub.

19 Claims, 5 Drawing Sheets

(51) Int. Cl.

| | |
|---|---|
| ***E21B 47/06*** | (2012.01) |
| ***E21B 33/076*** | (2006.01) |
| ***E21B 49/00*** | (2006.01) |

(56) References Cited

U.S. PATENT DOCUMENTS

| | | | |
|---|---|---|---|
| 3,662,826 | A | 5/1972 | Young et al. |
| 3,764,168 | A | 10/1973 | Kisling, III et al. |
| 4,547,691 | A | 10/1985 | Valdois et al. |
| 4,860,581 | A | 8/1989 | Zimmerman et al. |
| 5,394,345 | A | 2/1995 | Berard et al. |
| 6,526,819 | B2 | 3/2003 | Demarchos et al. |
| 6,799,469 | B2 | 10/2004 | Demia et al. |
| 6,905,241 | B2 | 6/2005 | Zazovsky et al. |
| 7,183,778 | B2 | 2/2007 | Homan et al. |
| 7,367,394 | B2 | 5/2008 | Villareal et al. |
| 7,379,180 | B2 | 5/2008 | Vannuffelen et al. |
| 7,647,980 | B2 | 1/2010 | Corre et al. |
| 7,705,982 | B2 | 4/2010 | Triana et al. |
| 7,874,199 | B2 | 1/2011 | Chaudoreille et al. |
| 7,934,547 | B2 | 5/2011 | Mikovisch et al. |
| 8,015,869 | B2 | 9/2011 | Nold, III et al. |
| 2002/0139527 | A1 | 10/2002 | Song et al. |
| 2008/0053652 | A1* | 3/2008 | Corre et al. ..... 166/179 |
| 2009/0283323 | A1* | 11/2009 | Quernheim et al. ..... 175/40 |

OTHER PUBLICATIONS

Chia, C. R. et al, "A New Method for Improving LWD Logging Depth", presented at SPE Annual Conference and Exhibition in San Antonio, TX, Sep. 24-27, 2006, SPE 102175-MS, pp. 1-9.

Dong, C. et al, "New Downhole-Fluid-Analysis Tool for Improved Reservoir Characterization", SPE 108566, Dec. 2008, pp. 1107-1116.

Siswantoro, M. P. et al, "The Application of Modular Formation Dynamics Tester-MDT with a Dual Packer Module in Difficult Conditions in Indonesia", SPE 54273, Apr. 1999, pp. 1-6.

* cited by examiner

OILFIELD OPERATION USING A DRILL STRING

BACKGROUND OF THE DISCLOSURE

U.S. Pat. No. 3,643,505 entitled "PROGRAMMED OFFSHORE FORMATION TESTERS" describes an apparatus for making automatic formation evaluation tests in a well bore. To accomplish this, a formation tester is provided with timing means for controlling execution of various predetermined operations, such execution continuing from initiation to termination of the test with no requirement for operator intervention. The apparatus is of particular utility in an offshore environment wherein the continually changing elevation of the vessel with respect to the subsea well bore characteristically makes surface control difficult.

U.S. Pat. No. 3,653,439 entitled "SUBSURFACE SAFETY VALVE" describes a combination slip joint and safety valve apparatus including an inner member telescopically and non-rotatably disposed within an outer member, a barrier means for blocking the bore through the members, a normally-open flow course extending past the barrier means and adapted to be closed by a longitudinally movable valve sleeve, and a means responsive to complete telescoping or closing movement of the members for moving the valve sleeve between open and closed positions.

U.S. Pat. No. 3,662,826 entitled "OFFSHORE DRILL STEM TESTING" describes apparatus for offshore drill stem testing from a floating vessel using a tester operated by upward and downward motion and coupled to a packer by a slip-joint, the equipment being suspended in the well bore on upper and lower pipe string sections connected together by a slip-joint. The tester and slip-joints are balanced with respect to fluid pressure so that a sequence of free points observed on the rig weight indicator at the surface provides positive indications of operation of the tools.

U.S. Pat. No. 3,764,168 entitled "DRILLING EXPANSION JOINT APPARATUS" describes a slip or expansion joint for use in a drill string which includes a mandrel telescopically disposed within a housing with splines to prevent relative rotation. The housing includes a bottom sub having attached thereto a tube extending upwardly in spaced relation to the adjacent housing section to provide an annular cavity that is placed in communication with the well annulus by ports. A seal assembly is mounted on the upper end of the tube and seals against the lower portion of the mandrel which is slidably received in the tube.

U.S. Pat. No. 7,647,980 entitled "DRILLSTRING PACKER ASSEMBLY" discloses a packer assembly for use in wellbore operations including a first packer and a second packer interconnected by an adjustable length spacer. The spacer provides a mechanism for adjusting the distance between the first packer and the second packer when the assembly is positioned in a wellbore.

PCT Patent Application Pub. No. WO2008/100156 entitled "ASSEMBLY AND METHOD FOR TRANSIENT AND CONTINUOUS TESTING OF AN OPEN PORTION OF A WELL BORE" discloses an assembly for transient and continuous testing of an open portion of a well bore, the assembly being arranged in a lower part of a drill string. The assembly comprises: a minimum of two packers fixed at the outside of the drill string, the packers being expandable for isolating a reservoir interval; a down-hole pump for pumping formation fluid from the reservoir interval; a mud driven turbine or electric cable for energy supply to the down-hole pump; a sample chamber; sensors and telemetry for measuring fluid properties; a closing valve for closing the fluid flow from the reservoir interval; and a circulation unit for mud circulation from a drill pipe to an annulus above the packers and feeding formation fluid from the down-hole pump to the annulus. The sensors and telemetry are for measuring and real-time transmission of the flow rate, pressure and temperature of the fluid flow from the reservoir interval, from the down-hole pump, in the drill string and in an annulus above the packers. The circulation unit can feed formation fluid from the reservoir interval into the annulus, so that a well at any time can be kept in over balance and so that the mud in the annulus at any time can solve the formation fluid from the reservoir interval.

The entire disclosures of U.S. Pat. No. 3,643,505, U.S. Pat. No. 3,653,439, U.S. Pat. No. 3,662,826, U.S. Pat. No. 3,764,168, U.S. Pat. No. 7,647,980 and PCT Patent Application Pub. No. WO2008/100156 are incorporated herein by reference.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1A:
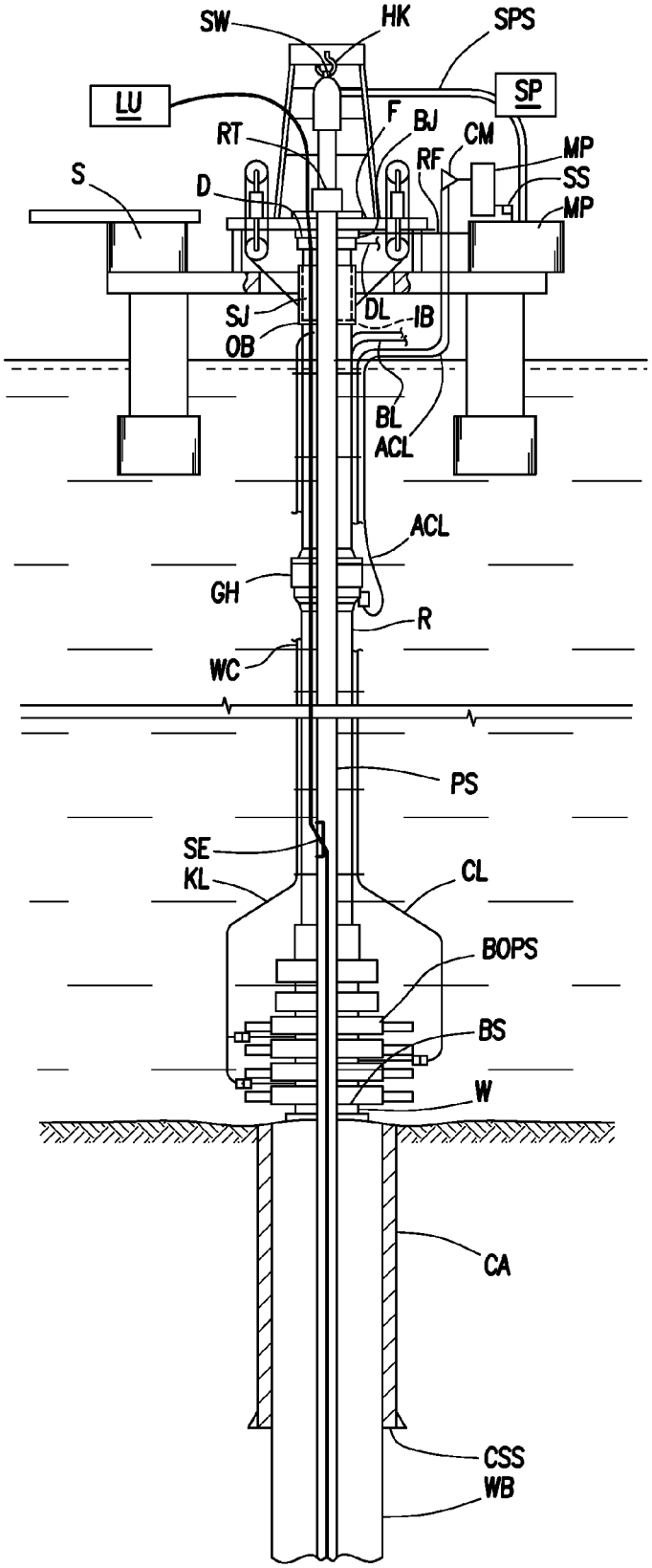
FIGS. 1A-1B are schematic views of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

One or more aspects of the present disclosure relate to formation testing in an open hole environment. Formation testing is routinely performed to evaluate an underground reservoir. Formation testing typically includes a drawdown phase, during which a pressure perturbation is generated in the reservoir by pumping formation fluid out of the reservoir, and a build-up phase, during which pumping is stopped and the return of a sand-face pressure to equilibrium is monitored. Various reservoir parameters may be determined from the monitored pressure, such as formation fluid mobility in the reservoir and distances between the well being tested and flow barriers in the reservoir.

The present disclosure describes apparatus and methods that facilitate performing open hole formation testing. One or more aspects of the apparatus and/or methods described herein may alleviate well control while performing formation testing. For example, an apparatus according to one or more aspects of the present disclosure may comprise a formation testing assembly configured to permit a hydraulic bladder or packer of a blow-out-preventer or similar device to be closed around the formation testing assembly during formation testing, thereby sealing a well annulus. A method according to one or more aspects of the present disclosure may include circulating drilling mud into a bore of the formation testing assembly down to a downhole circulation sub or unit and back up through the well annulus during at least a portion of a formation test. A formation fluid pumped from the reservoir may be mixed downhole with the circulated drilling mud according to suitable proportions. The mixture of pumped formation fluid and drilling mud may be circulated back to a surface separator via a choke line and/or a kill line towards a choke manifold. Wellbore sensors may be provided to more accurately interpret formation testing measurements.

One or more aspects of the present disclosure relate to the compensation of thermal expansion and/or contraction of a well string. Well strings are routinely used during wellbore operations (such as formation testing). Well strings may be used, for example, to convey formation evaluation tools in a wellbore extending through a subterranean formation. Well strings may also be used to circulate a fluid, such as drilling mud or other wellbore fluid, between an up-hole location and a down-hole location through an internal bore of the well string.

When fluids are circulated in a well string between locations that are not at the same temperature (for example, between a surface mud pit and a circulation sub provided at a lower end of the well pipe), the circulated fluids may induce temperature changes in the well string. These temperature changes affect in turn the length of the well pipe due to thermal expansion and/or contraction effects. In some cases, it may be useful to provide annular seals between the well pipe and the wellbore wall, or other devices configured to contact the wellbore wall (such as a sidewall coring tool, a pressure probe, or a sampling probe, among others). When these seals or other devices are separated by sufficient distances, changes in length of the well pipe between these seals may lead to large forces applied to the annular seals or other devices. These forces may compromise the function of the seals or other devices, and/or mechanically damage the seals or other devices. One or more aspects of an apparatus and/or method of the present disclosure may allow for compensating the thermal expansion of a well string, which may alleviate the risk of compromising and/or damaging seals disposed at distant locations on the well string.

One or more aspects of apparatus and/or methods described herein may permit adequate operation of a well string having a field joint configured to compensate for thermal expansion and/or contraction of the well string caused by, for example, different circulation rates of drilling mud in an internal bore therethrough. One or more aspects of apparatus and/or methods described herein may permit detecting and/or accounting for creeping or other deformations of inflatable packers or other devices disposed on a well string caused by thermal expansion and/or contraction of the well string.

FIG. 1A shows an offshore well site in which a formation tester system according to one or more aspects of the present disclosure may be used. The formation tester system can, however, be used onshore within the scope of the present disclosure. The well site system is disposed above an open hole wellbore WB that is drilled through subsurface formations. However, part of the wellbore WB may be cased using a casing CA.

The well site system includes a floating structure or rig S maintained above a wellhead W. A riser R is fixedly connected to the wellhead W. A conventional slip or telescopic joint SJ, comprising an outer barrel OB affixed to the riser R and an inner barrel IB affixed to the rig S and having a pressure seal therebetween, is used to compensate for the relative vertical movement or heave between the rig S and the riser R. A ball joint BJ may be connected between the top inner barrel IB of the slip joint SJ and the rig S to compensate for other relative movement (horizontal and rotational) or pitch and roll of the rig S and the riser R.

Usually, the pressure induced in the wellbore WB below the sea floor is only that generated by the density of the drilling mud held in the riser R (hydrostatic pressure). The overflow of drilling mud held in the riser R may be controlled using a rigid flow line RF provided about the level of the rig floor F and below a bell-nipple. The rigid flow line RF may communicate with a drilling mud receiving device such as a shale shaker SS and/or a mud pit MP. If the drilling mud is open to atmospheric pressure at the rig floor F, the shale shaker SS and/or the mud pit MP may be located below the level of the rig floor F.

During some operations (such as when performing open hole formation testing), gas can unintentionally enter the riser R from the wellbore WB. One or more of a diverter D, a gas handler and annular blow-out preventer GH, and a blow-out preventer stack BOPS may be provided. The diverter D, the gas handler and annular blow-out preventer GH, and/or the blow-out preventer stack BOPS may be used to limit gas accumulations in the marine riser R and/or to prevent low pressure formation gas from venting to the rig floor F. The diverter D, the gas handler and annular blow-out preventer GH, and/or the blow-out preventer stack BOPS, may not be activated when a pipe string such as pipe string PS is manipulated (rotated, lowered and/or raised) in the riser R, and may only be activated when indications of gas in the riser R are observed and/or suspected.

The diverter D may be connected between the top inner barrel IB of the slip joint SJ and the rig S. When activated, the diverter D may be configured to seal around the pipe string PS using packers and to convey drilling mud and gas away from the rig floor F. For example, the diverter D may be connected to a flexible diverter line DL extending from the housing of the diverter D to communicate drilling mud from the riser R to a choke manifold CM. The drilling mud may then flow from the choke manifold CM to a mud-gas buster or separator MB and optionally to a flare line (not shown). The drilling mud may then be discharged to the shale shaker SS, mud pit MP, and/or other drilling mud receiving device(s).

The gas handler and annular blow-out preventer GH may be installed in the riser R below the riser slip joint SJ. The gas handler and annular blow-out preventer GH may be configured to provide a flow path for mud and gas away from the rig floor F, and/or to hold limited pressure on the riser R upon activation. For example, a hydraulic bladder may be used to provide a seal around the pipe string PS. An auxiliary choke line ACL may be used to circulate drilling mud and/or gas from the riser R via the gas handler annular blow-out preventer GH to the choke manifold CM on the rig S.

The blow-out preventer stack BOPS may be provided between a casing string CS or the wellhead W and the riser R.

The blow-out preventer stack BOPS may be provided with one or more ram blow-out preventers. In addition, one or more annular blow-out preventers may be positioned in the blow-out preventer stack BOPS above the ram blow-out preventers. When activated, the blow-out preventer stack BOPS may provide a flow path for mud and/or gas away from the rig floor F, and/or to hold pressure on the wellbore WB. For example, the blow-out preventer stack BOPS may be in fluid communication with a choke line CL and a kill line KL connected between the desired ram blow-out preventers and/or annular blow-out preventers, as is known by those skilled in the art. The choke line CL may be configured to communicate with choke manifold CM. In addition to the choke line CL, the kill line KL and/or a booster line BL may be used to provide a flow path for mud and/or gas away from the rig floor F.

Figure 1B:
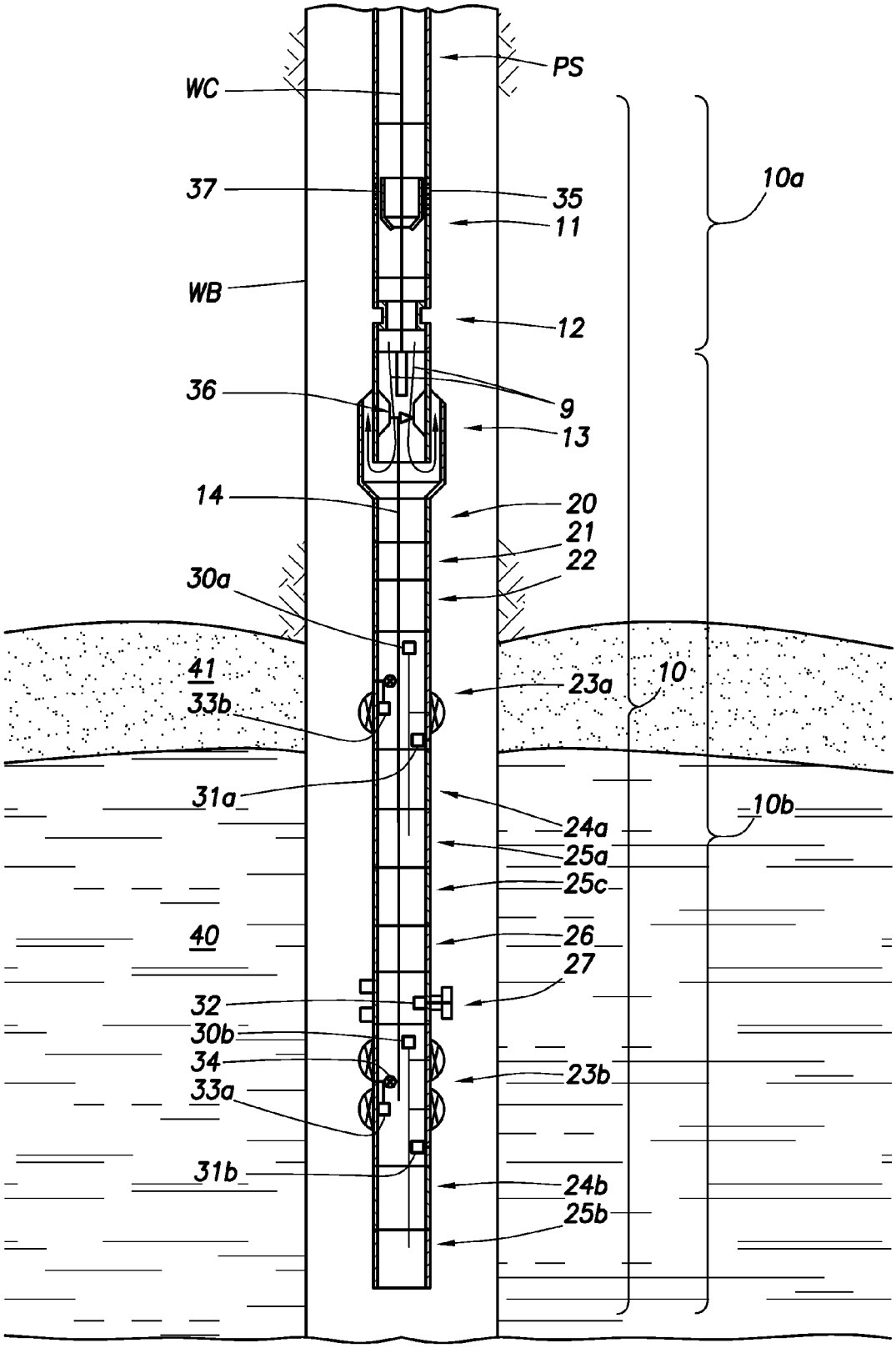

Referring collectively to FIGS. 1A and 1B, the well site system includes a derrick assembly positioned on the rig S. A drill string including a pipe string portion PS and a tool string portion at a lower end thereof (e.g., the tool string 10 in FIG. 1B) may be suspended in the wellbore WB from a hook HK of the derrick assembly. The hook HK may be attached to a traveling block (not shown), through a rotary swivel SW which permits rotation of the drill string relative to the hook. The drill string may be rotated by the rotary table RT, which is itself operated by well known means. For example, the rotary table RT may engage a kelly at the upper end of the drill string. As is well known, a top drive system (not shown) could alternatively be used instead of the kelly, rotary table RT and rotary swivel SW.

The surface system further includes drilling mud stored in a mud tank or mud pit MP formed at the well site. A surface pump SP delivers the drilling mud to an interior bore of the pipe string PS via a port in the swivel SW, causing the drilling mud to flow downwardly through the pipe string PS. The drilling mud may alternatively be delivered to an interior bore of the pipe string PS via a port in a top drive (not shown). The drilling mud may exit the pipe string PS via a fluid communicator configured to allow fluid communication with an annulus between the tool string and the wellbore wall, as indicated by arrows 9. The fluid communicator may comprise a jet pump. The jet pump may comprise an auxiliary outlet (not shown) configured to route a portion of the drilling mud towards a cooling loop associated with one or more heat-generating elements in the tool string. For example, the drilling mud may be routed through a flow path or passage and past or adjacent a heat exchanger to which the heat-generating component is coupled and thereafter discharged into the wellbore or wellbore. The jet pump may also be configured to mix the drilling mud with a formation fluid pumped from the formation, as further explained below. The drilling mud and/or the mixture of drilling mud and pumped formation fluid may then circulate upwardly through the annulus region between the outside of the drill string and the wall of the wellbore WB, whereupon the drilling mud and/or the mixture of drilling mud and pumped formation fluid may be diverted to one or more of the choke line CL, the kill line KL, and/or the booster line BL, among other return lines. A liquid portion of drilling mud and/or the mixture of drilling mud and pumped formation fluid may then be returned to the mud pit MP via the choke manifold CM and the mud-gas buster or separator MB. A gas portion may be flared, vented or disposed of at the rig S.

The surface system further includes a logging unit LU. The logging unit LU typically includes capabilities for acquiring, processing, and storing information, as well as for communicating with the tool string 10 and/or other sensors, such as a stand pipe pressure and/or temperature sensor SPS, a blow-out-preventer stack pressure and/or temperature sensor BS, and/or a casing shoe pressure and/or temperature sensor CSS. The logging unit LU may include a controller having an interface configured to receive commands from a surface operator. The controller in logging unit LU may be further configured to control the pumping rate of the surface pump SP.

In the shown example, the logging unit LU is communicatively coupled to an electrical wireline cable WC. The wireline cable WC is configured to transmit data between the logging unit and one or more components of the tool string (e.g., the tool string 10 in FIG. 1B). For example, one segment of the pipe string may include a side entry sub SE. The side entry sub SE may comprise a tubular device with a cylindrical shape and having an opening on one side. The side opening may allow the wireline cable WC to enter/exit an internal bore of the pipe string PS, thereby permitting the pipe string segments to be added or removed without having to disconnect (unlatch and latch) the wireline cable WC from surface equipment. Thus, the side entry sub SE may provide a quick and easy means to run a tool string (e.g., the tool string 10 of FIG. 1B) to a suitable depth at which formation testing may be performed without having to unlatch the wireline from the tool. While a wireline cable WC is shown in FIG. 1A to provide data communication, other means for providing data communication between the components of the tool string 10 and the logging unit LU either ways (i.e., uplinks and/or downlinks) may be used, including Wired Drill Pipe (WDP), acoustic telemetry, and/or electromagnetic telemetry.

In the shown example, the wireline cable WC is further configured to send electrical power to one or more components of the tool string 10. However, other means for providing electrical power to the components of the tool string may be used, including a mud driven turbine housed at the end of the pipe string PS.

FIG. 1B is a schematic view of the tool string 10 configured for conveyance in the wellbore WB extending into the subterranean formation. The tool string 10 is suspended at the lower end of the pipe string PS. The tool string 10 may be of modular type. For example, the tool string 10 may include one or more of a cross-over sub 11, a slip joint 12, and a diverter sub 13 fluidly connected to the interior bore in the pipe string PS. The tool string 10 may also include a tension-compression sub 20, a telemetry cartridge 21, a power cartridge 22, a plurality of packer modules 23*a* and 23*b*, a plurality of pump modules 24*a* and 24*b*, a plurality of sample chamber modules 25*a*, 25*b*, and 25*c*, a fluid analyzer module 26, and a probe module 27. For example, these later modules or cartridges may be implemented using downhole tools similar to those used in wireline operations.

The cross-over sub 11 (optional) may include a hollow mandrel having a cross-over port 35 and an annular sleeve 37 carried within the hollow mandrel and reciprocable between a normally closed position and an open position in which the sleeve uncovers the cross-over port in the mandrel. In operation, the wireline cable may be removed and a ball (not shown) may be dropped and seated on the annular sleeve 37. As internal pressure in the pipe string is thereafter increased, the annular sleeve 37 may shift downwardly and uncover the cross-over port 35 in the mandrel which permits the flow of proppants or other completion fluid into the wellbore. The proppants may be used to seal formation fractures that may have been inadvertently generated during formation testing.

The slip joint 12 may be configured to permit relative translation between an upper portion of the tool string (i.e., the portion above the slip joint 12 in FIG. 1B) attached to the pipe string, and a lower portion of the tool string (i.e., the portion below the slip joint 12 in FIG. 1B), for example including one or more inflatable packers (e.g., disposed on packer modules 23*a* and/or 23*b*) configured to selectively engage the wall of the wellbore WB. For example, the slip-joint 12 may have an adjustable length of 5 feet between collapsed and expanded positions. The slip joint 12 may be pressure compensated. Thus, the slip joint 12 would not induce compression and/or tension forces in the tool string when drilling mud is circulated therethrough.

As previously discussed, the diverter sub 13 comprises a fluid communicator, such as provided with a jet pump, configured to allow fluid communication with an annulus between the tool string and the wellbore wall. The jet pump includes a flow area restriction 36 disposed in the path 9 of the drilling mud towards in an interior bore of the diverter sub 13. Upon circulation of the drilling mud, the flow area restriction 36 generates a high pressure zone (e.g., above the restriction as shown in FIG. 1B) and a low pressure zone (e.g., at the restriction as shown in FIG. 1B). The diverter sub is also fluidly coupled to a main flow line 14 in which pumped formation fluid may flow. The main flow line 14 may terminate at an exit port located in the low pressure zone of the jet pump. In operations, drilling mud and formation fluid may contemporarily be pumped in the jet pump. As the exit port of the main flow line is located in the low pressure zone of the jet pump, the output pressure of the main flow line may be lower than the hydrostatic or hydrodynamic pressure of the drilling mud in the annulus between the tool string and the wall of the wellbore WB. Thus, the amount of power used for pumping formation fluid through the main flow line and into the wellbore may be reduced, or conversely, the rate at which formation fluid may be pumped through the main flow line and into the wellbore using a given amount of power may be increased. Further, as the drilling mud velocity is higher in the low pressure zone, discharging pumped formation fluid in the low pressure zone may facilitate the mixing or dilution of pumped formation fluid into the circulated drilling mud.

The tension-compression sub 20 may be configured to measure the magnitude and direction of the axial force applied by the pipe string to the tool string. For example, the tension-compression sub may be implemented using a force sensor such as described in U.S. Pat. No. 6,799,469, the entire disclosure of which is incorporated herein by reference.

The telemetry cartridge 21 and power cartridge 22 may be electrically coupled to the wireline cable WC via a logging head connected to the tool string below the slip joint (not shown). The telemetry cartridge 21 may be configured to receive and/or send data communication to the wireline cable WC. The telemetry cartridge 21 may comprise a downhole controller (not shown) communicatively coupled to the wireline cable WC. For example, the downhole controller may be configured to control the inflation/deflation of packers (e.g., packers disposed on packer modules 23*a* and/or 23*b*), the opening/closure of valves to route fluid flowing in the main flow line in the tool string and/or the pumping of formation fluid, for example by adjusting the pumping rate of a sampling device disposed in the tool string, such as the pump module 24*b*. The downhole controller may further be configured to analyze and/or process data obtained, for example, from various sensors in disposed in the tool string (e.g., pressure/temperature gauges 30*a*, 30*b*, 31*a*, 31*b*, 32*a*, 32*b* and/or 33, and/or fluid analysis sensors disposed in the fluid analyzer module 26), and/or to communicate measurement or processed data to the surface for subsequent analysis. The power cartridge 22 may be configured to receive electrical power from the wireline cable WC and supply suitable voltages to the electronic components in the tool string.

One or more of the pump modules (e.g., 24*a*) may be configured to pump fluid from the formation via a fluid communicator to the wellbore and into the main flow line 14 through which the obtained fluid may flow and be selectively routed to sample chambers in sample chamber modules (e.g., 25*c*) and/or to fluid analyzer modules (e.g. 26), and/or may be discharged in the wellbore as discussed above. Example implementations of the pump module may be found in U.S. Pat. No. 4,860,581 and/or U.S. Patent Application Pub. No. 2009/0044951, the entire disclosures of which are incorporated herein by reference. Additionally, one or more of the pump modules (e.g., 24*a* and/or 24*b*) may be configured to pump an inflation fluid conveyed in a sample chamber module (e.g., 25*a*, 25*b*) in and/or out of inflatable packers disposed on packers modules (e.g., 23*a* and/or 23*b*) in the tool string 10.

The fluid analyzer module 26 may be configured to measure properties or parameters of the fluid extracted from the formation. For example, the fluid analyzer module 26 may include a fluorescence spectroscopy sensor (not shown), such as described in U.S. Pat. No. 7,705,982, the entire disclosure of which is incorporated herein by reference. Further, the fluid analyzer module 26 may include an optical fluid analyzer (not shown), for example as described in U.S. Pat. No. 7,379,180, the entire disclosure of which is incorporated herein by reference. Still further, the fluid analyzer module 26 may comprise a density/viscosity sensor (not shown), for example as described in U.S. Patent Application Pub. No. 2008/0257036, the entire disclosure of which is incorporated herein by reference. Yet still further, the fluid analyzer module may include a resistivity cell (not shown), for example as described in U.S. Pat. No. 7,183,778, the entire disclosure of which is incorporated herein by reference. An implementation example of sensors in the fluid analyzer module may be found in a "New Downhole-Fluid Analysis-Tool for Improved Reservoir Characterization" by C. Dong et al. SPE 108566, December 2008. It should be appreciated however that the fluid analyzer module 26 may include any combination of conventional and/or future-developed sensors within the scope of the present disclosure. The fluid analyzer module 26 may be used to monitor one or more properties or parameters of the fluid pumped through the main flow line 14. For example, the density, viscosity, gas-oil-ratio (GOR), gas content (e.g., methane content C1, ethane content C2, propane-butane-pentane content C3-C5, carbon dioxide content CO2), and/or water content (H2O) may be monitored.

The packer modules 23*a* and/or 23*b* may be of a type similar to the one described in "The Application of Modular Formation Dynamics Tester—MDT* with a Dual Packer Module in Difficult Conditions in Indonesia" by Siswantoro M P, T. B. Indra, and I. A. Prasetyo, SPE 54273, April 1999. The packer modules 23*a* and/or 23*b* may include a wellbore pressure and/or temperature gauge (e.g., 31*a*, 31*b*) configured to measure the pressure/temperature in the wellbore annulus. The packer modules 23*a* and/or 23*b* may also include an inflation pressure gauge (e.g., 30*a*, 30*b*) configured to measure the pressure in the packers. The packer modules 23*a* and/or 23*b* may include an inlet pressure and/or temperature gauge (e.g., 33*a*, 33*b*) configured to monitor the pressure/temperature of fluid pumped in the main flow line 14, of fluid inside two packers defining a packer interval, and/or of fluid above or below a packer. The pressure and/or temperature gauge may be implemented similarly to the gauges described in U.S. Pat. No. 4,547,691, and 5,394,345 (the entire disclosures of which are incorporated herein by reference), strain gauges, and combinations thereof. The packer modules 23*a* and/or 23*b* may include a by-pass flow line (not shown) for establishing a wellbore fluid communication across the packer interval. In operations, the packer modules 23*a* and/or 23*b* may be used to isolate a portion of the annulus between the tool string 10 and the wall of the wellbore WB. The packer modules 23*b* may also be used to extract fluid from the formation via an inlet. A fluid communicator (e.g., including the isolation valve 34) disposed in the packer module 23*b* may be configured to selectively prevent fluid communication between the main flow line 14 (and thus the tool string 10) and the wellbore annulus. While the packer modules 23*a* and/or 23*b* are shown provided with two or less inflatable packers in FIG. 1B, the packer modules 23*a* and/or 23*b* may alternatively be provided with two or more packers, for example as illustrated in U.S. Patent Application Publication No. 2010/0050762, filed on Sep. 2, 2008, the entire disclosure of which is incorporated herein by reference. In these cases, multiple packers may be used to mechanically stabilize a sealed-off section of the wellbore (e.g., an inner interval) in which pressure testing and/or fluid sampling operations may be performed. Thus, build-up pressure measured in the stabilized sealed-off section may be less affected by transient changes of wellbore pressure around the multiple packer system.

The probe module 27 may include extendable setting pistons and an extendable sealing probe configured to selectively establish a fluid communication with the formation beyond the wall of the wellbore WB. The probe module 27 may also include a drawdown piston (not shown) to lower the pressure in the fluid communication with the formation below formation pressure. The probe module may also comprise a pressure and/or temperature gauge 32, which may, for example, similar to the pressure/temperature gauges 33*a* and/or 33*b*. When the probe of the probe module 27 is extended into sealing engagement with the formation, the pressure and/or temperature gauge 32 may be used to measure the pressure disturbances in the formation caused by pumping fluid from the formation between the packers of the packer module 23*b* (i.e., to perform a vertical interference test VIT). When the probe of the probe module 27 is retracted from the wall of the wellbore WB, the pressure and/or temperature gauge 32 may be used to measure the pressure and/or temperature in the wellbore annulus.

The sample chamber modules 25*a*, 25*b*, and 25*c* may each comprise one or more sample chambers. For example, the sample chamber modules 25*a* and 25*b* may each comprise a large sample chamber configured to convey an inflation fluid (such as water) into the wellbore. The inflation fluid may be used to inflate the packers of the packer modules 23*a* and 23*b* using, for example, the pump modules 24*a* and 24*b*, respectively, to force water into the inflatable packers. The sample chamber module 25*c* may comprise a plurality of sample chambers configured to retain one or more samples of formation fluid pumped from the formation. For example, the sample chamber module 25*c* may be implemented similarly to the description of the sample chamber module described in U.S. Pat. No. 7,367,394, the entire disclosure of which is incorporated herein by reference.

Figure 2:
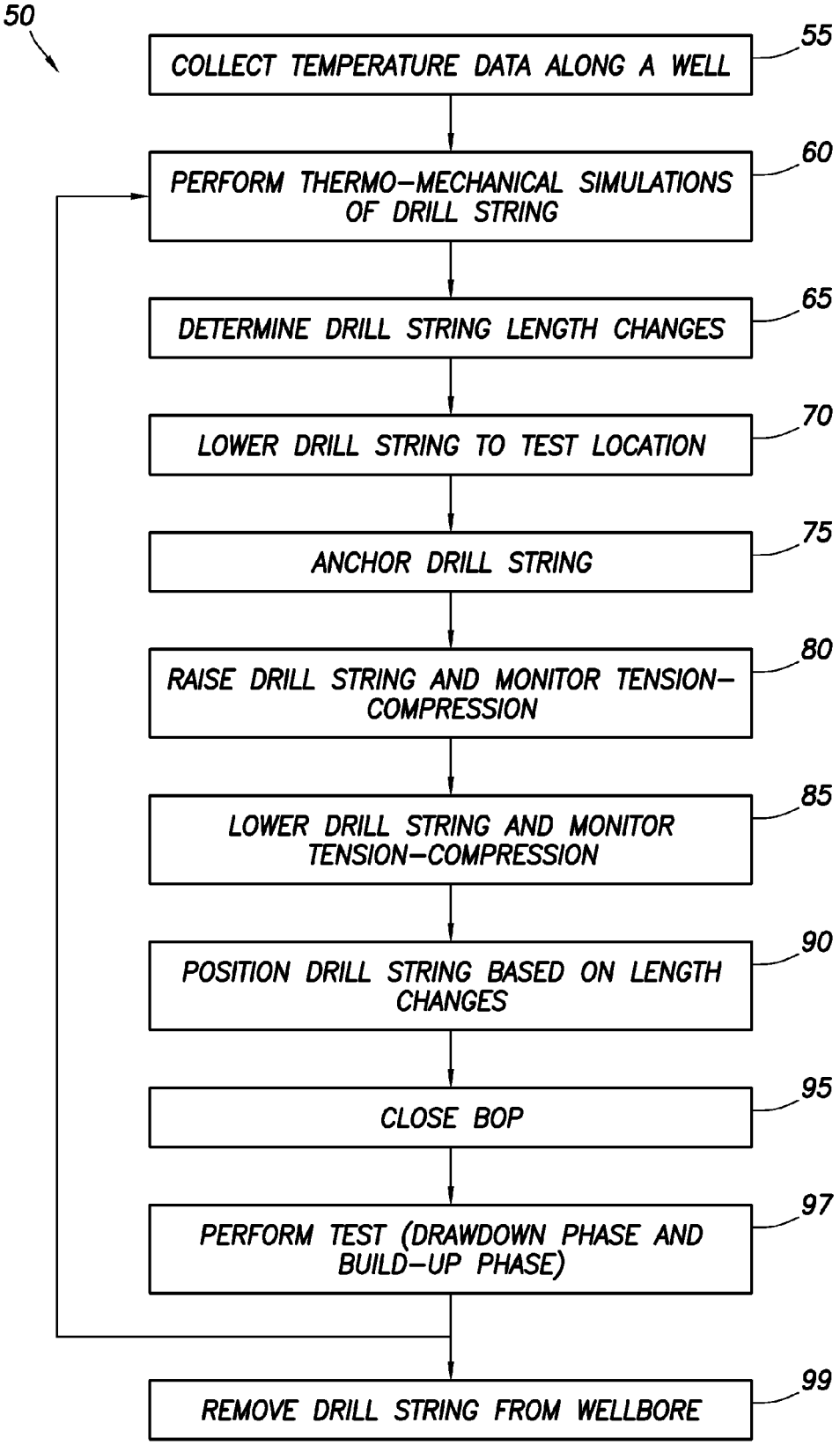
FIG. 2 is a flow-chart diagram of at least a portion of a method according to one or more aspects of the present disclosure.

FIG. 2 is a flow-chart diagram of at least a portion of a method 50 of compensating the thermal expansion/contraction of a well string according to one or more aspects of the present disclosure. The method 50 may be used when performing open hole formation testing. For example, the method 50 may be performed using, for example, the well site system of FIG. 1A and/or the formation tester tool string 10 of FIG. 1B. It should be appreciated that the order of execution of the steps depicted in FIG. 2 may be changed and/or some of the steps described may be combined, divided, rearranged, omitted, eliminated and/or implemented in other ways.

At step 55, formation temperature data along a well (e.g., the wellbore WB of FIGS. 1A and 1B) may be collected. The formation temperature data (e.g., temperature profile, sea floor temperature, geothermal gradient) may have been collected during previous stages of the formation of the well, or may be collected using the temperature sensors provided with the tool string 10 shown in FIG. 1B. For example, a method of determining virgin formation temperature as described in U.S. Pat. No. 6,905,241 (the entire disclosure of which is incorporated herein by reference) may be used, among other methods.

At step 60, thermo-mechanical simulations of a drill string lowered in the well at one or more planned testing locations in response of drilling mud circulation may be performed. For example, the drill string may comprise a tool string (e.g., the tool sting 10 shown in FIG. 1B) suspended in the wellbore from a pipe string (e.g., the pipe string PS shown in FIG. 1A). The thermo-mechanical simulations may be used to predict the temperature and the tension/compression forces applied to the pipe string. The thermo-mechanical simulations may take into account the drilling mud circulation rate and the thermal properties of the drilling mud, the pipe string, and the formations penetrated by the well. The thermo-mechanical simulations may also take into account friction forces between the pipe string and the wellbore wall, the effect of buoyancy and gravity, and the effect of pressure differential between the pipe inner diameter and wellbore. An example simulation package that may be used to perform such thermo-mechanical simulations is described in SPE Paper Number 102175-MS entitled "A New Method for Improving LWD Logging Depth" by C. R. Chia, H. Laastad, A. Kostin, F. Hjortland, and G. Bordakov, in SPE Annual Technical Conference and Exhibition, 24-27 Sep. 2006, San Antonio, Tex., USA. However, other simulation packages may alternatively be used within the scope of the present disclosure.

At step 65, changes in the length of the drill string (e.g., including the changes in length of the pipe string PS shown in FIGS. 1A and 1B) due to temperature changes may be determined from the thermo-mechanical simulations. For example, the thermo-mechanical simulations may be used to determine the following length changes. At first the effect of lowering a tool string and a pipe string in a wellbore in thermal equilibrium with the formation temperature may be simulated. For example, the pipe string may be assumed to be initially at surface ambient temperature, for example a lower temperature than the formation temperature. The thermo-mechanical simulations may describe the evolution of the pipe string temperature towards thermal equilibrium with the formation temperature. Thus, thermo-mechanical simulations may be used to determine the resulting pipe string thermal expansion due to the temperature increase of the pipe when it is lowered in the well. Then, the effects of drilling mud circulation in an internal bore of the pipe string and towards a wellbore annulus may be simulated. For example, the circulated drilling mud may be assumed to be initially at surface ambient temperature. The thermo-mechanical simulations may describe the cooling of the pipe string by the circulated drilling mud as drilling mud circulation occurs at a given rate for a predetermined amount of time. Thus, thermo-mechanical simulations may be used to determine the resulting pipe string thermal contraction due to the cooling of the pipe string by the circulation of the drilling mud. Then, the effect of stopping the mud circulation for an extended period of time may be simulated. For example, thermo-mechanical simulations may describe the resuming of the evolution of the pipe string temperature towards thermal equilibrium with the formation temperature. Thus, thermo-mechanical simulations may be used to determine the resulting pipe string thermal expansion due to the temperature increase of the pipe when drilling mud circulation is stopped. It should be appreciated that other characteristics may also be determined at step 65, such as the force applied by the tool string on packers expanded into frictional engagement with the wellbore wall.

At step 70, the drill string (e.g., including the tool string 10 shown in FIG. 1B suspended in the wellbore from a pipe string the pipe string PS shown in FIG. 1A) may be lowered in a well (e.g., the wellbore WB) at one testing location (e.g., adjacent the formation 40 shown in FIG. 1B). The drill string may include a slip-joint (e.g., the slip-joint 12 shown in FIG. 1B).

At step 75, a first portion of the drill string (e.g., the lower portion 10*b* shown in FIG. 1B) may be positionally fixed with respect to the wellbore. For example, packers disposed on the drill string (e.g., packers provided with the packer modules 23*a* and/or 23*b*) may be expanded into sealing engagement with the wall of the well (e.g., the wall of the wellbore WB shown in FIG. 1B). Additionally, or alternatively, anchoring members (e.g., the extendable anchors 45 and/or setting pistons of the probe module 27 shown in FIG. 1B) may be extended to anchor the tool string provided at the end of the drill string.

At step 80, the second portion the drill string (e.g., including the upper portion 10*a* shown in FIG. 1B and the pipe string PS shown in FIGS. 1A and 1B) may be raised while monitoring the tension-compression between the slip joint (e.g., the slip joint 12 shown in FIG. 1B) and the packer or anchor extended at step 75.

At step 85, a second portion of the drill string may be lowered while monitoring the tension-compression between the slip-joint (e.g., the slip-joint 12 shown in FIG. 1B) and the packer or anchor extended at step 75. For example, the tension-compression may be monitored using the tension-compression sub 20 shown in FIG. 1B and disposed below the slip joint 12. The monitored tension-compression may be used to determine a second string position corresponding to a collapsed position of the slip-joint.

At step 90, the drill string length (including the length of the slip joint) may be adjusted based on the changes in length of the drill string due to temperature changes determined at step 65. For example, the second portion of the drill string may be positioned between the first and second positions determined respectively at steps 80 and 85 such that the changes in length of the drill string due to temperature changes would not entirely expand or collapse the slip-joint.

At step 95, the second portion of the drill string may be positionally fixed with respect to the wellbore. For example, a hydraulic bladder provided with the blow-out-preventer stack BOPS shown in FIG. 1A may be closed to seal a well annulus. However, other sealing devices (such as the diverter D and/or the gas handler and annular blow-out preventer GH shown in FIG. 1A) may alternatively or additionally be used to seal a well annulus.

At step 97, a test may be performed using the tool string provided at the end of the drill string. For example, the test may include a drawdown phase wherein drilling mud is circulated during at least a portion of the drawdown phase and mixed with fluid pumped from the formation. The test may also include a build-up phase wherein drilling mud is not circulated during at least a portion of the build-up phase for reducing pressure disturbances caused by drilling mud circulation on build-up pressure measurements. Thus, the slip-joint may compensate for thermal expansion and/or contraction of the drill string during the test and minimize the forces applied to the packers and/or anchors extended at step 75.

One or more of the steps 60, 65, 70, 75, 80, 85, 90, 95 and 97 may be repeated at one or more locations in the wellbore, until the drill string is retrieved from the wellbore at step 99.

Figure 3:
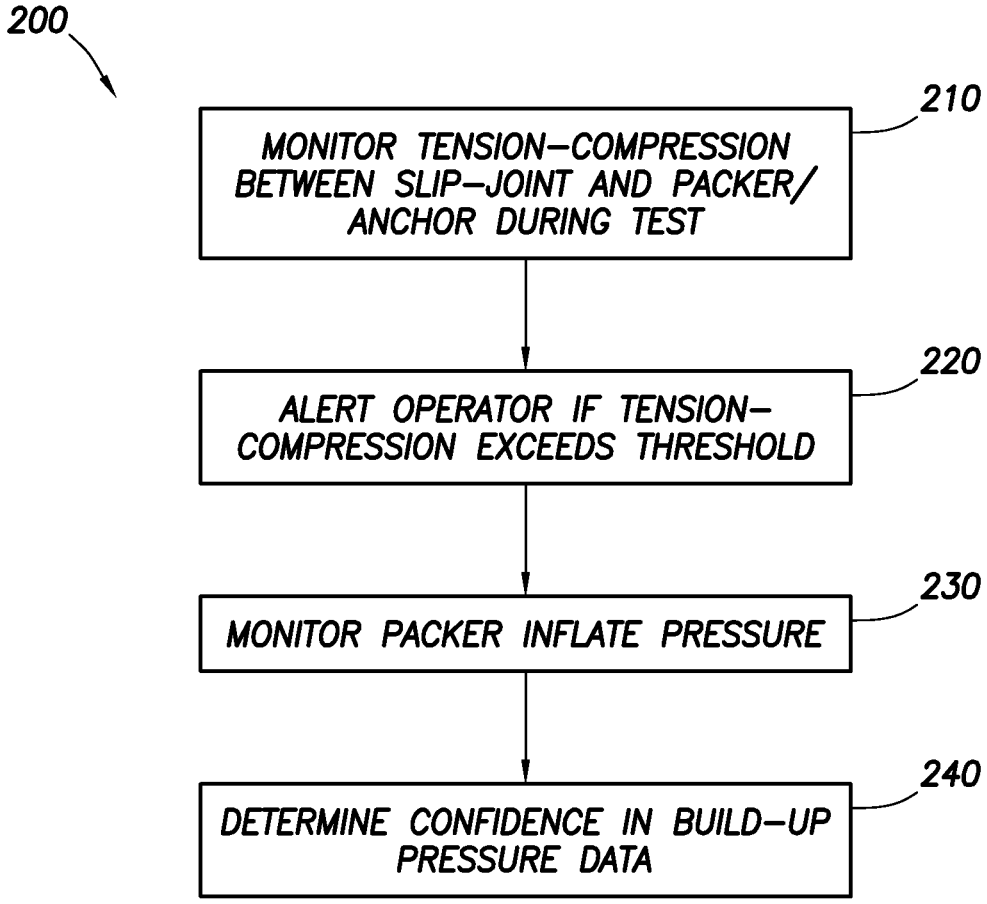
FIG. 3 is a flow-chart diagram of at least a portion of a method according to one or more aspects of the present disclosure.

FIG. 3 is a flow-chart diagram of at least a portion of a method 200 of monitoring the thermal expansion/contraction of a well string according to one or more aspects of the present disclosure. The method 200 may be performed using, for example, the formation tester tool string 10 shown in FIG. 1B. The method 200 may be performed as part of the step 97 shown in FIG. 2. It should be appreciated that the order of execution of the steps depicted in FIG. 3 may be changed and/or some of the steps described may be combined, divided, rearranged, omitted, eliminated and/or implemented in other ways.

At step 210, tension-compression between a slip-joint and a packer/anchor in a drill string may be monitored during a test. For example, the tension-compression may be monitored using the tension-compression sub 20 shown in FIG. 1B and disposed below the slip joint 12 shown in FIG. 1B. The tension-compression measurements may be used to determine a confidence in the interpretation of build-up pressure. For example, excessive values of the tension-compression may be indicative of movement or deformation of the packers, and/or movement of the tool string. Such movement or deformation may induce a volume change of the producing packer interval. This volume change may, in turn, generate a pressure disturbance at the pressure gauge 33*a* that may not be related to the response of the formation to be tested. Thus, artifacts in the interpretation of build-up pressure that would otherwise be erroneously attributed to the response of the formation to be tested may thus be attributed to movement or deformation of the packers due to changes in the length of the drill string.

At step 220, a surface operator may be alerted if the tension-compression monitored at step 210 is above a threshold. For example, the threshold may be indicative that the slip joint has reached an abutting position (i.e., completely extended or completely collapsed). Alternatively, the threshold may be indicative that the force applied by the tool string on packers expanded into frictional engagement with the wellbore wall may lead to creeping or other deformations of the packers.

At step 230, the inflate pressure inside the packers may be monitored. For example, the inflate pressure may be monitored using pressure gauges 30*a* and/or 30*b* in FIG. 1B. The inflate pressure data may be used to determine a confidence in the interpretation of build-up pressure. For example, rapid pressure changes inside the packers may be indicative of creeping or other deformations of the packers and/or movement of the tool string. These deformations may induce a volume change of the producing packer interval. This volume change may, in turn, generate a pressure disturbance at the pressure gauge 33*a*, that may not be related to the response of the formation to be tested. Thus, artifacts in the interpretation of build-up pressure that would otherwise be erroneously attributed to the response of the formation to be tested may be attributed to movements of the packers with respect to the wellbore wall, and/or movements of the tool string.

At step 240, a confidence in the interpretation of build-up pressure data may be determined. For example, the tension-compression and/or the change of inflate pressure in packers monitored at step 220 and 230 respectively may be compared to threshold values. If below the threshold value, the confidence that features observed on the build-up pressure data can be interpreted as formation response may be high. Otherwise, the confidence that features observed on the build-up pressure data can be interpreted as formation response may be low.

Figure 4:
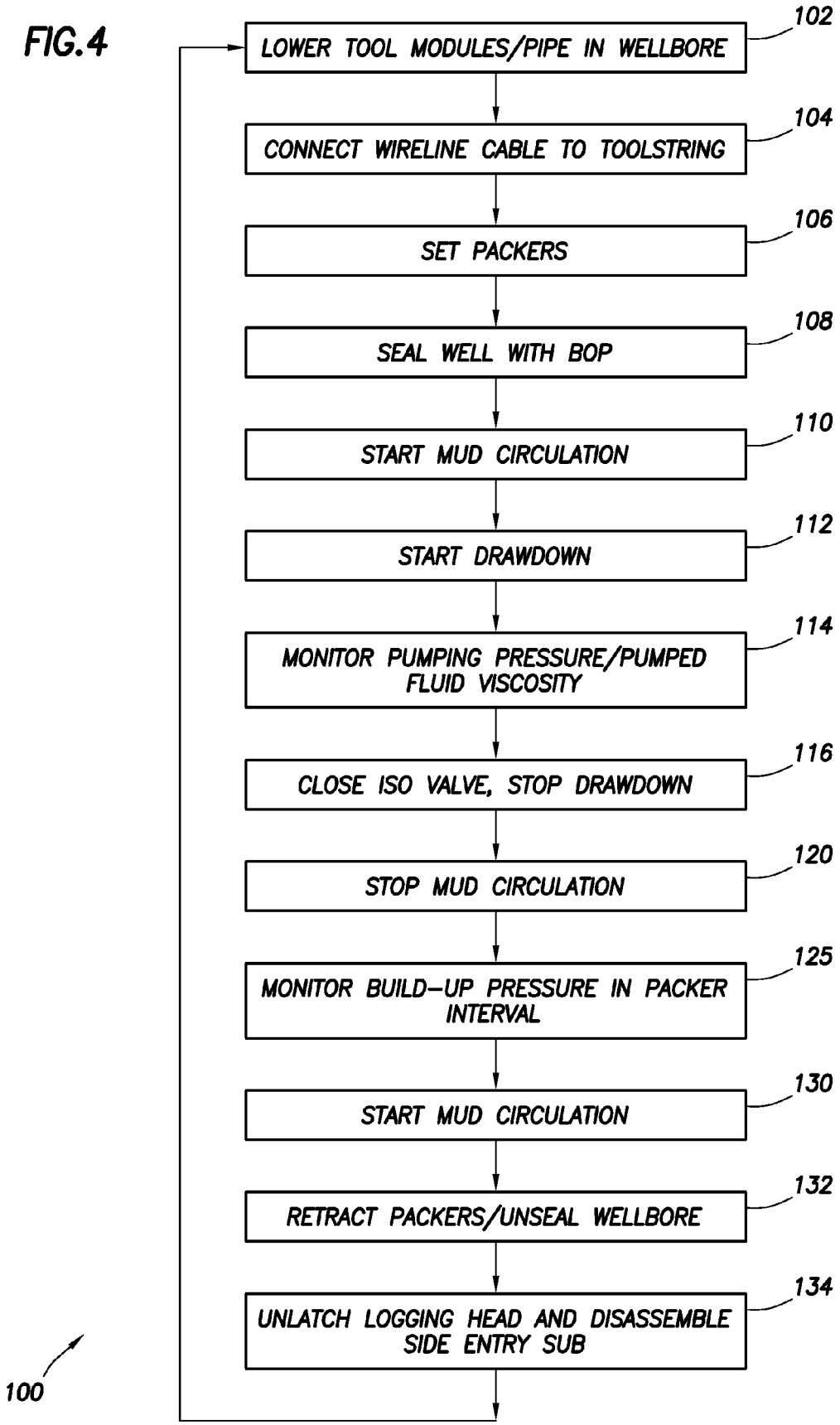
FIG. 4 is a flow-chart diagram of at least a portion of a method according to one or more aspects of the present disclosure.

FIG. 4 is a flow-chart diagram of at least a portion of a method 100 of performing formation testing according to one or more aspects of the present disclosure. The method 100 may be performed using, for example, the well site system of FIG. 1A and/or the tool string 10 of FIG. 1B. The method 100 may permit closing a hydraulic bladder or packer of the blow-out-preventer around the assembly during formation testing, thereby sealing a well annulus. It should be appreciated that the order of execution of the steps depicted in FIG. 4 may be changed and/or some of the steps described may be combined, divided, rearranged, omitted, eliminated and/or implemented in other ways.

At step 102, modules of a tool string (e.g., the modules of the tool string 10 of FIG. 1B) and segments of a pipe string (e.g., segments of the pipe string PS of FIGS. 1A and/or 1B) are assembled to form a drill string to be lowered at least partially into a wellbore. The tool string and the pipe string segments may be assembled such that the tool string is adjacent or proximate the formation to be tested (e.g., the formation 40 in FIG. 1B).

At step 104, the side entry sub (e.g., the side entry sub SE of FIG. 1A), may be assembled to the rest of the drill string. The side entry sub may be operatively associated to a wireline cable (e.g., the wireline cable WC of FIGS. 1A and/or 1B). One end of the wireline cable may include a logging head. The logging head may be pumped down to the tool string (e.g., the tool string 10 of FIG. 1B) and may be latched thereto, thereby establishing an electrical communication between the modules in the tool string and a logging unit (e.g., the logging unit LU of FIG. 1A). The wireline cable may then be pulled in tension while maintaining the slip joint in a substantially expanded position. For example, the amount of tension may be determined so that the wireline cable is essentially loose when the slip joint is in a substantially collapsed position. The wireline cable may then be clamped to the side entry sub while in tension. Thus, the wireline cable may not be crushed as the slip joint collapses.

Additional pipe segments may be added to the drill string at step 104 until the tool string (for example the packer modules 23*a* and/or 23*b*) are suitably positioned in the wellbore relative to the formation to be tested (e.g., the formation 40 in FIG. 1B). However, the side entry sub position may be kept proximate the top end of the wellbore so that an annulus of the well may be sealed below the side entry sub. While the side entry sub SE is shown positioned above a blow-out preventer located at the sea floor in FIG. 1B, the side entry sub may alternatively be positioned above a gas handler and annular blow-out preventer (such as the gas handler and annular blow-out preventer GH of FIG. 1A), or above a diverter (such as the diverter D of FIG. 1A). For example, the side entry sub may alternatively be located above a rotary table (e.g., the rotary table RT of FIG. 1A).

At step 106, packers of the tool string (such as packers provided with the packer modules 23*a* and/or 23*b* of the tool string 10 in FIG. 1B) may be set. For example, a downhole pump (e.g., the downhole pump 24*b* in FIG. 1B) may be used to inflate the packers of a packer module (e.g., the packer module 23*b* in FIG. 1B) with an inflation fluid conveyed in a sample chamber module (e.g., the sample chamber module 25*b* in FIG. 1B). Thus, the packers may establish a fluid communication with the formation to be tested (e.g., the formation 40 in FIG. 1B). In addition, other packers may also be inflated to isolate a portion of the wellbore from pressure fluctuations caused by the circulation of drilling mud. For example, a downhole pump (e.g., the downhole pump 24*a* in FIG. 1B) may be used to inflate the packers of another packer module (e.g., the packer module 23*a* in FIG. 1B) with an inflation fluid conveyed in a sample chamber module (e.g., the sample chamber module 25*a* in FIG. 1B). As shown in FIG. 1B, the packer module 23*a* is positioned sufficiently spaced apart from the packer module 23*b* and/or sufficiently close to the diverter sub 13 so that the formation to be tested 40 is less affected by drilling mud circulation above the packer module 23*a*. In some cases, the packer module 23*a* may be set against another formation (e.g., formation 41 in FIG. 1B), known or suspected to be hydraulically isolated from the formation 40. One or more of the steps described in FIG. 2, such as steps 80, 85 and 90, may also be performed at step 106.

At step 108, a hydraulic bladder, such as a hydraulic bladder provided with the blow-out preventer BOPS in FIG. 1A, is extended into sealing engagement against the pipe string to seal a well annulus below the side entry sub. As mentioned before, other sealing devices may be used to seal a well annulus at step 108.

At step 110, circulation of drilling mud in the well is initiated. For example, the drilling mud may be pumped from a mud pit (e.g., the mud pit MP in FIG. 1A) down into a bore of the formation testing assembly using a surface pump (e.g., the surface pump SP in FIG. 1A). The drilling mud may be introduced into the pipe string to a port in a rotary swivel (e.g., the rotary swivel SW in FIG. 1A) or through a port in a top drive. The drilling mud may then flow down in the pipe string to a downhole circulation sub (e.g., the diverter sub 13 of FIG. 1B) and back up through the well annulus. The drilling mud may then be routed to one or more return lines (e.g., the choke line CL, the kill line KL, and/or the booster line BL in FIG. 1A) towards a choke manifold (e.g., the choke manifold CM in FIG. 1A) and a mud-gas buster or separator (e.g., the mud-gas buster MB), thereby reducing the risk of the drilling venting downhole gases on the rig floor (e.g., the rig floor F in FIG. 1A).

At step 112, the downhole tool string (e.g., the pump module 24*a* of the downhole tool string 10 in FIG. 1B) is operated to pump fluid from the formation (e.g., the formation 40) through the interval defined by a packer module (e.g., the packer module 23*b* in FIG. 1B) and into a flow line of the downhole tool string (e.g., the main flow line 14 in FIG. 1B). The fluid pumped from the formation may be mixed with circulated drilling fluid. For example, the formation fluid may be mixed in appropriate proportions with drilling mud at a diverter sub (e.g., the diverter sub 13 in FIG. 1B) as previous mentioned. Thus, the formation fluid may be carried away in the drilling mud towards a mud-gas buster (e.g., the mud-gas buster MB in FIG. 1A), which may facilitate well control while performing formation testing.

At step 114, a pressure of the fluid pumped from the formation is monitored, for example using the pressure and/or temperature gauge 33*a* in FIG. 1A. In addition, a parameter of the fluid pumped is also monitored, for example using a sensor provided with the fluid analyzer module 26 in FIG. 1B. The pumped fluid parameter may be one or more of a viscosity, a density, a gas-oil-ratio (GOR), a gas content (e.g., methane content C1, ethane content C2, propane-butane-pentane content C3-C5, carbon dioxide content CO2), and/or a water content (H2O), among other parameters. A pumped fluid viscosity value may be stored and used subsequently to determine a formation permeability from the formation fluid mobility.

At step 116, an isolation valve (e.g., the isolation valve 34 in FIG. 1B) may be closed to isolate the producing interval between the packers (e.g., the packers of the packer module 23*b*) from the tool string. The isolation valve may be closed once sufficient fluid has been pumped from the formation to be tested and halt pumping from the formation. Then, the downhole tool string may be operated to halt pumping (e.g., halt pumping by the pump module 24*a* of the downhole tool string 10 in FIG. 1B).

At step 120, the circulation of drilling mud may be stopped or halted. This optional step may be performed, for example, when the circulation of drilling may affect the confidence into the interpretation of build-up pressure monitored at step 125. For example, circulation of drilling fluid may induce flow of drilling mud filtrate through a mud-cake lining the wall of the wellbore penetrating the formation to be tested. The flow of drilling mud filtrate may, in turn, generate pressure disturbances measurable in the packer interval isolated at step 116. These pressure disturbances may negatively affect the interpretation of the pressure measurement data collected at step 125. In some cases, step 120 may be performed before step 116, for example to stop or halt drilling mud circulation before initiating a build-up start.

At step 125, build-up pressure monitoring in the producing interval isolated at step 116 is initiated. For example, the pressure and/or temperature gauge 33*a* in FIG. 1A may still be used, as the pressure and/or temperature gauge 33*a* is still in pressure communication with the producing interval when the isolation valve 34 is closed. Monitoring may continue for several hours, depending for example on how fast the pressure in the formation to be tested returns to equilibrium. One or more of the steps described in reference to FIG. 3, such as steps 210 and 220, may also be performed at step 125.

At step 130, the circulation of drilling mud may be restarted, for example when the monitoring of build-up pressure in producing packer interval initiated at step 125 is deemed sufficient. This step may be performed when fluid pumped from the formation and mixed with the drilling mud is still present in the well. By circulating this mixture towards a mud-gas buster or separator (e.g., the mud-gas buster MB in FIG. 1A), gas that may be present in the well may be essentially vented away from the rig floor before unsealing the well.

At step 132, the packers set at step 106 may be retracted or deflated and the BOP hydraulic bladder used to seal the well annulus around the pipe string at step 108 may be retracted.

At step 134, the logging head may be unlatched, and the side entry sub may be disassembled. The tool string may be positioned in the wellbore for a formation test at another location in the same well. For example, pipe segments may be added or removed to alter the length of the drill string. A portion of the steps shown in FIG. 4 may be repeated.

In view of all of the above and FIGS. 1-4, it should be readily apparent to those skilled in the art that the present disclosure provides a method comprising collecting temperature data at a plurality of locations along a wellbore extending into a subterranean formation, performing thermo-mechanical simulations of a drill string in response to mud circulation, wherein the drill string comprises a tool string suspended in the wellbore from a pipe string, determining changes in length of the pipe string due to temperature changes, positionally fixing the tool string at one of the locations, and adjusting the length of the pipe string based on the determined change in length of the pipe string. The method may further comprise raising the pipe string, while monitoring at least one of a tension and compression of the pipe string, towards a first position at which a slip joint is substantially expanded, and lowering the pipe string, while monitoring at least one of a tension and compression of the pipe string, towards a second position at which the slip joint of the pipe string is substantially collapsed. Adjusting the length of the pipe string may be further based on the first and second positions. The method may further comprise lowering a drill string in a wellbore until a side entry sub of the drill string is proximate a top end of the wellbore, wherein the side entry sub is configured to allow a wireline cable to enter a bore of the drill string, and pumping a logging head affixed to an end of the wireline cable down to the tool string. The method may further comprise pulling the wireline cable in tension while maintaining the slip joint in a substantially expanded position, and clamping the wireline cable to the side entry sub. The method may further comprise closing a blow-out-preventer bladder around the pipe string after adjusting the length of the pipe string. The method may further comprise performing a test using the tool string, wherein mud circulates during at least a portion of the test, and wherein mud does not circulate during at least another portion of the test. The method may further comprise monitoring at least one of a tension and compression of the pipe string during at least a portion of the test. The method may further comprise alerting an operator when the monitored at least one of the tension and compression exceeds a predetermined threshold. The method may further comprise determining a confidence in test data based on at least one of monitored tension of the pipe string, monitored compression of the pipe string, and monitored pressure inside one or more packers defining a test interval. The method may further comprise determining at least one of a tension and compression of the pipe string due to temperature changes. The method may further comprise repeating the determining, positionally fixing, and adjusting steps at another one or more of the locations.

The present disclosure also provides a method comprising lowering a drill string in a wellbore until a side entry sub of the drill string is proximate a top end of the wellbore, wherein the wellbore extends into a subterranean formation, wherein the drill string includes a tool string suspended on a pipe string, and wherein the side entry sub is configured to allow a wireline cable to enter a bore of the drill string, positioning the side entry sub above a blow-out-preventer, closing a blow-out-preventer around the drill string below the side entry sub, circulating mud in the drill string towards a circulation sub, and operating the tool string to perform a test. Positioning the side entry sub above a blow-out-preventer may comprise positioning the side entry sub above a rotary table. The method may further comprise pumping a logging head down to the tool string before closing the blow-out-preventer bladder. The method may further comprise setting two packers defining a packer interval before operating the tool string to pump formation fluid from the formation through the packer interval, closing an isolation valve to isolate the packer interval, and monitoring build-up pressure in the packer interval. The method may further comprise halting mud circulation. The method may further comprise opening the blow-out-preventer bladder, and disassembling the logging head and the side entry sub. The method may further comprise altering the length of the drill string, reassembling the side entry sub, and repeating the positioning, closing, circulating, and operating steps. The method may further comprise pumping a logging head affixed to an end of a wireline cable down to the tool string. The method may further comprise pulling the wireline cable in tension while maintaining the slip joint in a substantially expanded position, and clamping the wireline cable to the side entry sub.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

What is claimed is:

1. A method, comprising:

collecting temperature data at a plurality of locations along a wellbore extending into a subterranean formation;

performing thermo-mechanical simulations of a drill string in response to mud circulation, wherein the drill string comprises a tool string suspended in the wellbore from a pipe string;

determining changes in length of the drill string due to temperature changes;

positionally fixing the tool string at one of the locations; and adjusting the length of the drill string based on the determined change in length of the drill string.

2. The method of claim 1 further comprising:

raising the drill string, while monitoring at least one of a tension and compression of the drill string, towards a first position at which a slip joint is substantially expanded;

lowering the drill string, while monitoring at least one of a tension and compression of the drill string, towards a second position at which the slip joint of the drill string is substantially collapsed; and wherein adjusting the length of the drill string is further based on the first and second positions.

3. The method of claim 2 wherein raising the drill string comprises raising the pipe string.

4. The method of claim 2 wherein lowering the drill string comprises lowering the pipe string.

5. The method of claim 2 wherein raising the drill string comprises raising the pipe string and a first portion of the tool string while a second portion of the tool string is fixed within the wellbore.

6. The method of claim 2 wherein lowering the drill string comprises lowering the pipe string and a first portion of the tool string while a second portion of the tool string is fixed within the wellbore.

7. The method of claim 1 further comprising:

lowering the drill string in a wellbore until a side entry sub of the drill string is proximate a top end of the wellbore, wherein the side entry sub is configured to allow a wireline cable to enter a bore of the drill string; and;

pumping a logging head affixed to an end of the wireline cable down to the tool string.

8. The method of claim 7 further comprising:

pulling the wireline cable in tension while maintaining the slip joint in a substantially expanded position; and clamping the wireline cable to the side entry sub.

9. The method of claim 1 further comprising closing a blow-out-preventer bladder around the drill string after adjusting the length of the drill string.

10. The method of claim 1 further comprising performing a test using the tool string, wherein mud circulates during at least a portion of the test, and wherein mud does not circulate during at least another portion of the test.

11. The method of claim 10 further comprising monitoring at least one of a tension and compression of the drill string during at least a portion of the test.

12. The method of claim 11 further comprising alerting an operator when the monitored at least one of the tension and compression exceeds a predetermined threshold.

13. The method of claim 11 wherein monitoring at least one of a tension and compression of the drill string comprises measuring the magnitude and direction of axial force applied by the pipe string to the tool string.

14. The method of claim 10 further comprising determining a confidence in test data based on at least one of:

monitored tension of the drill string;

monitored compression of the drill string; and monitored pressure inside one or more packers defining a test interval.

15. The method of claim 1 further comprising determining at least one of a tension and compression of the drill string due to temperature changes.

16. The method of claim 1 further comprising repeating the determining, positionally fixing, and adjusting steps at another one or more of the locations.

17. The method of claim 1 wherein determining changes in length of the drill string due to temperature changes comprises determining changes in length of the pipe string.

18. The method of claim 1 wherein determining changes in length of the drill string due to temperature changes comprises determining a thermal expansion of the pipe string based on the thermo-mechanical simulations.

19. The method of claim 1 wherein adjusting the length of the drill string comprises adjusting the length of a slip joint.

* * * * *